US011587489B2

(12) United States Patent
Zhou et al.

(10) Patent No.: US 11,587,489 B2
(45) Date of Patent: Feb. 21, 2023

(54) METHOD FOR DRIVING DISPLAY PANEL, DISPLAY PANEL AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Zhenguo Zhou, Beijing (CN); Xuewen Cao, Beijing (CN); Site Cai, Beijing (CN); Jian Ren, Beijing (CN); Xiaoping Zhang, Beijing (CN); Litao Fan, Beijing (CN); Xiaojuan Gao, Beijing (CN); Jian Zhang, Beijing (CN); Shuqian Dou, Beijing (CN); Yingxue Yu, Beijing (CN); Yujie Liu, Beijing (CN); Dongxu Yang, Beijing (CN); Yaodong Wang, Beijing (CN); Luo Zhang, Beijing (CN); Siqi Yin, Beijing (CN); Xianfeng Mao, Beijing (CN); Mengxing Xu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/515,196

(22) Filed: Oct. 29, 2021

(65) Prior Publication Data

US 2022/0165197 A1 May 26, 2022

(30) Foreign Application Priority Data

Nov. 20, 2020 (CN) ..... 202011308122.9

(51) Int. Cl.
*G09G 3/20* (2006.01)

(52) U.S. Cl.
CPC ... *G09G 3/2003* (2013.01); *G09G 2300/0443* (2013.01); *G09G 2300/0452* (2013.01); *G09G 2310/08* (2013.01); *G09G 2320/0219* (2013.01)

(58) Field of Classification Search
CPC ... G09G 2300/0443; G09G 2300/0452; G09G 2310/08; G09G 2320/0219; G09G 3/2003
See application file for complete search history.

(56) References Cited

U.S. PATENT DOCUMENTS

2004/0234163 A1* 11/2004 Lee ..... G09G 3/2003 382/298
2008/0278466 A1* 11/2008 Joo ..... G09G 3/3614 345/205

(Continued)

*Primary Examiner* — Kenneth Bukowski
(74) *Attorney, Agent, or Firm* — Nath, Goldberg & Meyer; Joshua B. Goldberg

(57) ABSTRACT

A method for driving display panel includes: for one of adjacent two frames of displayed images, when scanning odd-numbered row of sub-pixels, inputting data signals to the data lines coupled to the data selector in first order by a data selector; when scanning even-numbered row of sub-pixels, inputting data signals to the data lines coupled to the data selector in second order by the data selector; first and second orders each represents an order of inputting data signals to the data lines; first order is opposite to second order; for the other of the adjacent two frames of displayed images, when scanning odd-numbered row of sub-pixels, inputting data signals to the data lines coupled to the data selector in second order by the data selector; when scanning even-numbered row of sub-pixels, inputting data signals to the data lines coupled to the data selector in first order by the data selector.

14 Claims, 4 Drawing Sheets

(56) References Cited

U.S. PATENT DOCUMENTS

| | | | | |
|---|---|---|---|---|
| 2013/0222216 | A1* | 8/2013 | Park | G09G 3/3688 345/55 |
| 2014/0118657 | A1* | 5/2014 | Duan | G09G 3/364 257/59 |
| 2014/0198135 | A1* | 7/2014 | Eom | G09G 3/3275 345/82 |
| 2015/0371605 | A1* | 12/2015 | Wu | G09G 5/02 345/604 |
| 2016/0078836 | A1* | 3/2016 | Kim | G09G 3/3688 345/209 |
| 2016/0189640 | A1* | 6/2016 | Guo | G09G 3/3688 345/694 |
| 2018/0151145 | A1* | 5/2018 | Lee | G09G 3/3614 |
| 2018/0315384 | A1* | 11/2018 | Ikeda | G09G 3/007 |

* cited by examiner

GB image (odd-numbered row RBG, even-numbered row GBR)

| | G | G | G | G | MUX1 | MUX2 | MUX3 | MUX1 | MUX2 | MUX3 | MUX1 | MUX2 | MUX3 | MUX1 | MUX2 | MUX3 |
|---|---|---|---|---|---|---|---|---|---|---|---|---|---|---|---|---|
| odd-numbered row | - | - | - | - | R+ | G- | B+ | R- | G+ | W- | R+ | G- | B- | R- | G+ | W+ |
| even-numbered row | ↑ | ↓ | ↓ | ↑ | R+ | G- | W+ | R- | G+ | B- | R+ | G- | W- | R- | G+ | B+ |

RB image (odd-numbered row RBG, even-numbered row GBR)

| | | | | | | | | | | | | | | | | |
|---|---|---|---|---|---|---|---|---|---|---|---|---|---|---|---|---|
| | G | G | G | G | MUX1 | MUX2 | MUX3 | MUX1 | MUX2 | MUX3 | MUX1 | MUX2 | MUX3 | MUX1 | MUX2 | MUX3 |
| odd-numbered row | ↓ | ↓ | ↑ | ↑ | R+ | G- | B+ | R- | G+ | W- | R+ | G- | B- | R- | G+ | W+ |
| even-numbered row | - | - | - | - | R+ | G- | W+ | R- | G+ | B- | R+ | G- | W- | R- | G+ | B+ |

FIG. 2b

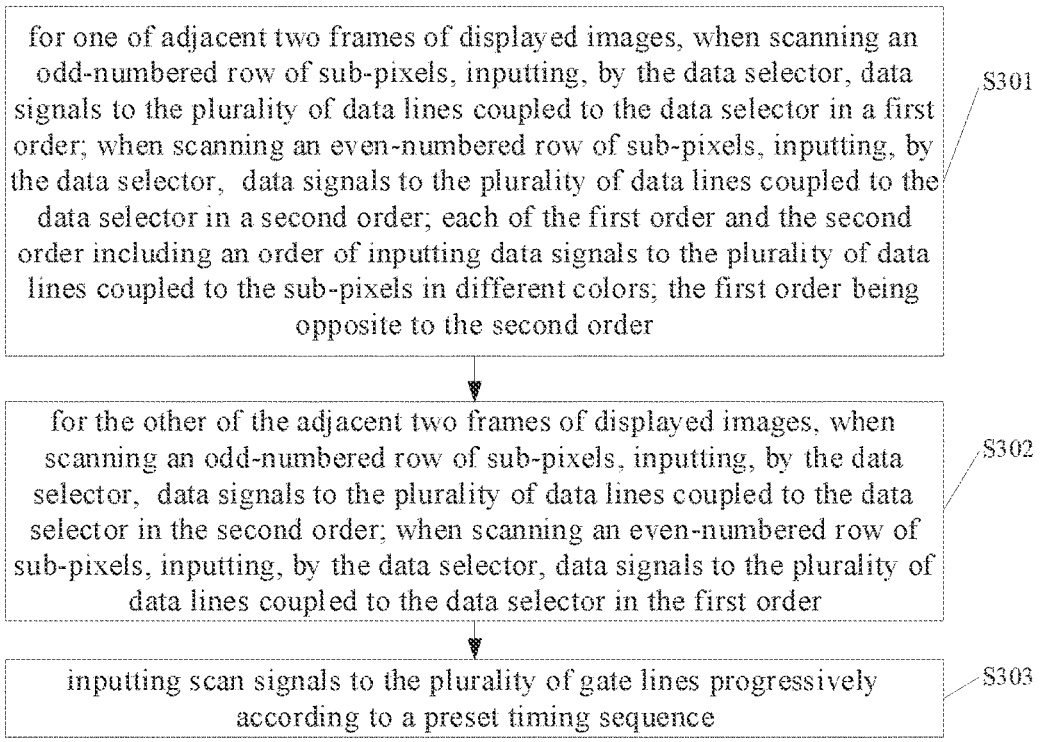

FIG. 3

GB image (odd-numbered row GBR, even-numbered row RBG)

| | | | | | | | | | | | | | | | | |
|---|---|---|---|---|---|---|---|---|---|---|---|---|---|---|---|---|
| | G | G | G | G | MUX1 | MUX2 | MUX3 | MUX1 | MUX2 | MUX3 | MUX1 | MUX2 | MUX3 | MUX1 | MUX2 | MUX3 |
| odd-numbered row | ↓ | ↑ | ↑ | ↓ | R- | G+ | B- | R+ | G- | W+ | R- | G+ | B+ | R+ | G- | W- |
| even-numbered row | - | - | - | - | R- | G+ | W- | R+ | G- | B+ | R- | G+ | W+ | R+ | G- | B- |

FIG. 4a

GB image（odd-numbered row GBR，even-numbered row RBG）
| | | | | | | | | | | | | | | | | |
|---|---|---|---|---|---|---|---|---|---|---|---|---|---|---|---|---|
| | G | G | G | G | MUX1 | MUX2 | MUX3 | MUX1 | MUX2 | MUX3 | MUX1 | MUX2 | MUX3 | MUX1 | MUX2 | MUX3 |
| odd-numbered row | - | - | - | - | R- | G+ | B- | R+ | G- | W+ | R- | G+ | B+ | R+ | G- | W- |
| even-numbered row | ↑ | ↑ | ↓ | ↓ | R- | G+ | W- | R+ | G- | B+ | R- | G+ | W+ | R+ | G- | B- |
FIG. 4b
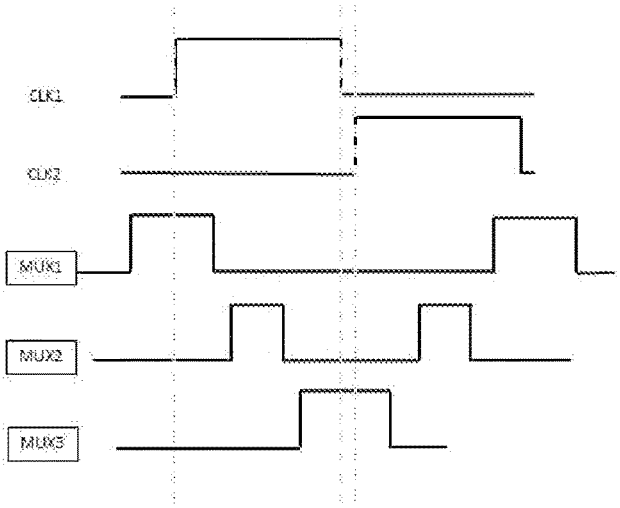
FIG. 5a
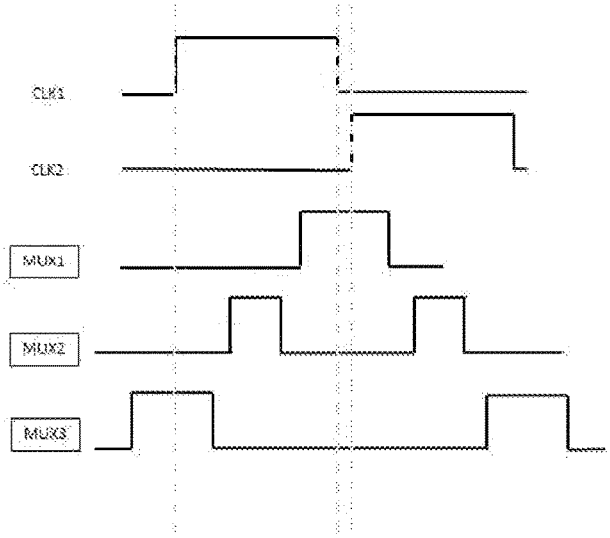
FIG. 5b

METHOD FOR DRIVING DISPLAY PANEL, DISPLAY PANEL AND DISPLAY DEVICE

CROSS-REFERENCE TO RELATED APPLICATIONS

The present disclosure claims the priority to Chinese patent application No. 202011308122.9, filed on Nov. 20, 2020, the disclosure of which is incorporated herein by reference in its entirety.

TECHNICAL FIELD

The present disclosure belongs to the field of display technologies, and particularly relates to a method for driving a display panel, a display panel and a display device.

BACKGROUND

With the continuous development of full-screen display panels, people have higher requirements for high-resolution display screens, and the density of sub-pixels in the display panels is getting increased, or the pixel density (Pixels Per Inch, PPI) has become too high, which results in limited space in the display panels for arranging data lines. The existing solution is to use data selector (or multiplexer. MUX) technology to share one data line for data lines coupled to multiple columns of sub-pixels, and to provide data signals for the data lines respectively through the MUX. However, the MUX technology increases the power consumption of the display panel, or potentially introduces display defects such as vertical stripes.

SUMMARY

As a first aspect, an embodiment of the present disclosure provides a method for driving a display panel. The display panel includes a plurality of sub-pixels in an array of a plurality of rows and a plurality of columns, a plurality of data lines and a plurality of data selectors. Sub-pixels in adjacent columns of the plurality of columns have colors different from each other, and sub-pixels having two different colors are alternately arranged in at least one column of the plurality of columns. Each of the plurality of data lines is coupled to sub-pixels in a same column, and each of the plurality of data selectors is coupled to the plurality of data lines coupled to sub-pixels in different colors.

The method includes: for one of adjacent two frames of displayed images, when scanning an odd-numbered row of sub-pixels, inputting, by a data selector of the plurality of the data selectors, data signals to the plurality of data lines coupled to the data selector in a first order; when scanning an even-numbered row of sub-pixels, inputting, by the data selector, data signals to the plurality of data lines coupled to the data selector in a second order, each of the first order and the second order representing an order of inputting data signals to the plurality of data lines coupled to the sub-pixels in different colors, the first order being opposite to the second order; and, for the other of the adjacent two frames of displayed images, when scanning an odd-numbered row of sub-pixels, inputting, by the data selector, data signals to the plurality of data lines coupled to the data selector in the second order; when scanning an even-numbered row of sub-pixels, inputting, by the data selector, data signals to the plurality of data lines coupled to the data selector in the first order.

In some embodiments, a data line to which a data signal is last input in the first order is the same as a data line to which a data signal is first input in the second order; and a data line to which a data signal is first input in the first order is the same as a data line to which a data signal is last input in the second order.

In some embodiments, the display panel includes a plurality of repetition units in an array; each of the plurality of repetition units includes sub-pixels in two rows and six columns, in which six sub-pixels in a first row are sequentially a red sub-pixel, a green sub-pixel, a blue sub-pixel, a red sub-pixel, a green sub-pixel, and a white sub-pixel; and six sub-pixels in a second row are sequentially a red sub-pixel, a green sub-pixel, a white sub-pixel, a red sub-pixel, a green sub-pixel, and a blue sub-pixel. The red sub-pixels are coupled to a first data line, the green sub-pixels are coupled to a second data line; and the blue sub-pixels and the white sub-pixels are coupled to a third data line.

The first order includes an order of the first data line, the third data line and the second data line for each of the plurality of repetition units.

The second order includes an order of the second data line, the third data line and the first data line for each of the plurality of repetition units.

In some embodiments, a duration of inputting a data signal to the third data line is longer than a duration of inputting a data signal to the first or second data line.

In some embodiments, the display panel further includes a plurality of gate lines; each of the plurality of gate lines is coupled to sub-pixels in a same row.

The method further includes: inputting scan signals to the plurality of gate lines row by row according to a preset timing sequence.

As a second aspect, an embodiment of the present disclosure provides a display panel, including: a plurality of sub-pixels in an array of a plurality of rows and a plurality of columns, a plurality of data lines, and a plurality of data selectors. Sub-pixels in adjacent columns of the plurality of columns have colors different from each other, and sub-pixels having two different colors are alternately arranged in at least one column of the plurality of columns; each of the plurality of data lines is coupled to sub-pixels in a same column; and each of the plurality of data selectors is coupled to the plurality of data lines coupled to sub-pixels in different colors.

The display panel further includes a timing controller coupled to a data selector of the plurality of data selectors and configured to: for one of adjacent two frames of displayed images, when scanning an odd-numbered row of sub-pixels, control the data selector to input data signals to the plurality of data lines coupled to the data selector in a first order; when scanning an even-numbered row of sub-pixels, control the data selector to input data signals to the plurality of data lines coupled to the data selector in a second order; each of the first order and the second order representing an order of inputting data signals to the plurality of data lines coupled to the sub-pixels in different colors; the first order being opposite to the second order; and for the other of the adjacent two frames of displayed images, when scanning an odd-numbered row of sub-pixels, control the data selector to input data signals to the plurality of data lines coupled to the data selector in the second order; when scanning an even-numbered row of sub-pixels, control the data selector to input data signals to the plurality of data lines coupled to the data selector in the first order.

In some embodiments, the display panel further includes a plurality of repetition units in an array; each of the plurality of repetition units includes sub-pixels in two rows and six columns, in which six sub-pixels in a first row are sequentially a red sub-pixel, a green sub-pixel, a blue sub-pixel, a red sub-pixel, a green sub-pixel, and a white sub-pixel; and six sub-pixels in a second row are sequentially a red sub-pixel, a green sub-pixel, a white sub-pixel, a red sub-pixel, a green sub-pixel, and a blue sub-pixel. The red sub-pixels are coupled to a first data line, the green sub-pixels are coupled to a second data line; and the blue sub-pixels and the white sub-pixels are coupled to a third data line.

The first order includes an order of the first data line, the third data line and the second data line for each of the plurality of repetition units.

The second order includes an order of the second data line, the third data line and the first data line for each of the plurality of repetition units.

In some embodiments, the timing controller is further configured to control the data selector such that a duration of inputting a data signal to the third data line is longer than a duration of inputting a data signal to the first or second data line.

In some embodiments, the display panel further includes a first data selection signal line, a second data selection signal line and a third data selection signal line. The first data selection signal line is coupled to the first data line coupled to the red sub-pixels; the second data selection signal line is coupled to the second data line coupled to the green sub-pixels; and the third data selection signal line is coupled to the third data line coupled to the blue sub-pixels.

In some embodiments, the data selector includes a first transistor, a second transistor and a third transistor. A control electrode of the first transistor is coupled to the first data selection signal line, and a first electrode of the first transistor is coupled to the first data line coupled to the red sub-pixels; a control electrode of the second transistor is coupled to the second data selection signal line, and a first electrode of the second transistor is coupled to the second data line coupled to the green sub-pixels; a control electrode of the third transistor is coupled to the third data selection signal line, and a first electrode of the third transistor is coupled to the third data line coupled to the blue sub-pixels; and second electrodes of the first, second and third transistors are coupled together to receive a data signal.

As a third aspect, an embodiment of the present disclosure provides a display device, including any of the above display panels.

BRIEF DESCRIPTION OF DRAWINGS

FIG. 2*b* is a schematic diagram illustrating a signal jump state on data lines when an RB image is displayed on a display panel.

FIG. 3 is a schematic flowchart illustrating a method for driving a display panel according to an embodiment of the present disclosure.

FIG. 4*a* is a schematic diagram illustrating another signal jump state on data lines when a GB image is displayed on a display panel.

FIG. 4*b* is a schematic diagram illustrating another signal jump state on data lines when a RB image is displayed on a display panel.

FIG. 5*a* is a timing diagram illustrating the input of an exemplary data signal and data selection signal.

FIG. 5*b* is a timing diagram illustrating the input of another exemplary data signal and data selection signal.

DETAIL DESCRIPTION OF EMBODIMENTS

To enable those skilled in the art better understand the technical solutions of the present disclosure, the following detailed description is given with reference to the accompanying drawings and the specific embodiments.

Unless defined otherwise, technical or scientific terms used herein shall have the ordinary meaning as understood by one of ordinary skill in the art to which this disclosure belongs. The use of "first", "second" and the like in this disclosure is not intended to indicate any order, quantity, or importance, but rather is used to distinguish one element from another. Also, the use of the terms "a", "an" or "the" and similar referents do not denote a limitation of quantity, but rather denote the presence of at least one. The word "include" or "comprise", or the like, means that the element or item preceding the word includes the element(s) or item(s) listed after the word and their equivalent, but does not exclude other element(s) or item(s). The terms "connected" or "coupled" and the like are not restricted to physical or mechanical connections, but may include electrical connections, whether direct or indirect. The terms "upper", "lower", "left", "right", and the like are used only to indicate relative positional relationships, and when the absolute position of the object being described is changed, the relative positional relationships may also be changed accordingly.

In a display panel with a high pixel density, data lines coupled to multiple columns of sub-pixels commonly share one data line, and data signals are provided to the data lines respectively through a data selector. In order to solve the problem of high-power consumption caused by the data selector, a corresponding order of writing data signals may be adopted to reduce the power consumption as much as possible. However, the order of writing data signals commonly adopted at present often affects the display quality.

Taking a pixel unit in a display panel including a red sub-pixel R, a green sub-pixel G, a blue sub-pixel B. and a white sub-pixel W as an example, a RBGGBR mode is generally adopted to write data signals. That is, data signals are input to corresponding sub-pixels in the order of RBG in one of adjacent two rows of sub-pixels, and data signals are input to corresponding sub-pixels in the order of GBR in the other of the adjacent two rows of sub-pixels, so that the number of times of turning on the MUX can be reduced, thereby reducing power consumption. However, there is a jump in voltage due to the difference in polarities of voltage levels of the data signals of the white sub-pixel W and the blue sub-pixel B in the same column. Therefore, by adopting the above mode, a coupling capacitance may be easily formed between the signal lines coupled to the adjacent sub-pixels, which affects the actual brightness of the adjacent sub-pixels, thereby causing vertical stripes to be generated and causing non-uniformity of the displayed image.

Figures 1, 2A:
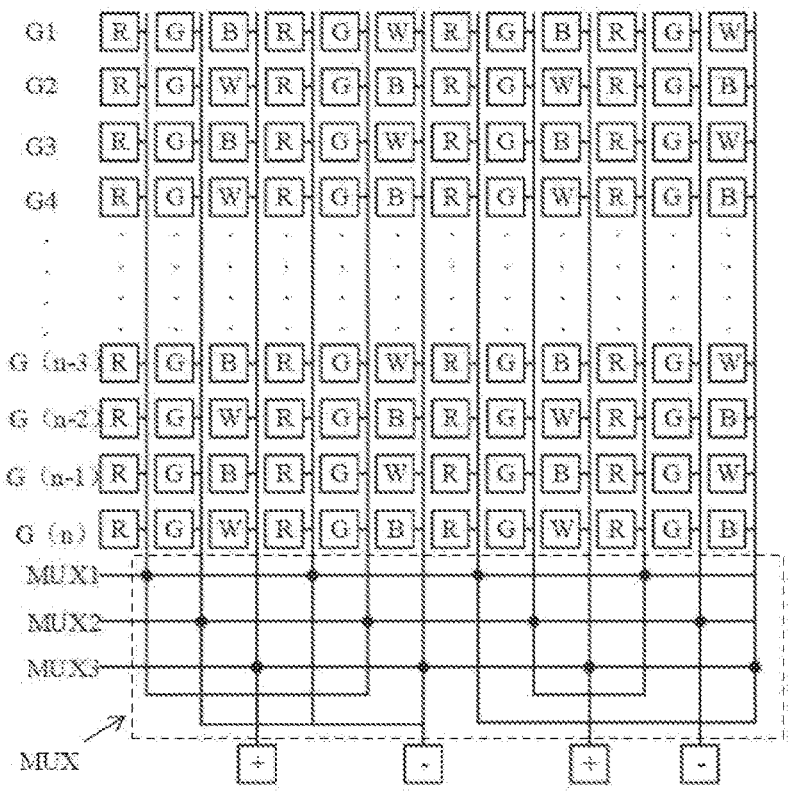
FIG. 1 is a schematic structural diagram of an exemplary display panel.
FIG. 2*a* is a schematic diagram illustrating a signal jump state on data lines when a GB image is displayed on a display panel.

FIG. 1 is a schematic structural diagram of an exemplary display panel, and as shown in FIG. 1, the display panel may include a plurality of sub-pixels arranged in an array of a plurality of rows and a plurality of columns. Among the plurality columns of sub-pixels, adjacent columns of sub-pixels have colors different from each other, and at least one column of sub-pixels includes alternately arranged sub-pixels having two different colors. The plurality of sub-pixels may also be arranged in an array in the form of a plurality of repetition units. Each repetition unit may include sub-pixels arranged in two rows and six columns, in which six sub-pixels in the first row are sequentially a red sub-pixel R, a green sub-pixel G, a blue sub-pixel B, a red sub-pixel R, a green sub-pixel G. and a white sub-pixel W; and six sub-pixels in the second row are sequentially a red sub-pixel R, a green sub-pixel G, a white sub-pixel W, a red sub-pixel R, a green sub-pixel G, and a blue sub-pixel B.

The display panel may further include a plurality of data selectors MUXs and a plurality of data lines. Each data line is coupled to sub-pixels arranged in the same column. For example, the data lines may include a first data line coupled to red sub-pixels R disposed in the first column, a second data line coupled to green sub-pixels G disposed in the second column, and a third data line coupled to blue sub-pixels B and white sub-pixels W disposed in the third column. Each data selector MUX is coupled to three data lines respectively coupled to the red, green, and blue (or white) sub-pixels R, G, and B (or W), and each data selector MUX is coupled to the first, second, and third data lines as described above through first, second, and third data selection signal lines MUX1, MUX2, and MUX3, respectively. The connection relationship between the data selector MUX, the data selection signal lines MUX1 to MUX3, and the data lines for different sub-pixels will be described later with reference to FIG. 6. However, the connection mode between the data selector MUX and the data lines is not limited thereto, but may be various depending on the hardware to be used, such as the driver chip, and the display mode to be realized. In addition, in the present application, when describing the order in which data signals are input, the order of "data lines" and the order of "data selection signal lines" have the same meaning, and thus may be used interchangeably with each other.

FIG. 2*a* is a schematic diagram of a signal jump state on data lines when a GB image is displayed on a display panel.

As shown in FIG. 2*a*, taking a GB image as an example, when an odd-numbered row of sub-pixels are scanned in one frame of displayed image, data signals may be sequentially input to the data lines coupled thereto in the order of the first data selection signal line MUX1, the third data selection signal line MUX3, and the second data selection signal line MUX2. For example, the data signals may be input in the order of the first data line, the third data line, and the second data line. That is, data signals are sequentially input to the data lines coupled to a red sub-pixel R, a blue sub-pixel B, a green sub-pixel G, a red sub-pixel R, a white sub-pixel W. and a green sub-pixel G in one repetition unit, so that the corresponding sub-pixels are turned on to realize display. In the display panel, the blue sub-pixel B and the white sub-pixel W are located in the same column and coupled to the same data line. Therefore, in the process of displaying the GB image, the data signal is different every time it is input to the data line coupled to the blue sub-pixel B and the white sub-pixel W, resulting in a voltage jump. However, when the data signals are input in the order of the first data line, the third data line and the second data line, since the green sub-pixel G is turned on after the blue sub-pixel B, the voltage jump does not cause a coupling effect for the green sub-pixel G, i.e., the brightness of the green sub-pixel G is not affected (represented by "–" in the figure).

In addition, when an even-numbered row of sub-pixels are scanned, the data signals may be sequentially input to the data lines coupled thereto in the order of the second data selection signal line MUX2, the third data selection signal line MUX3, and the first data selection signal line MUX1. For example, the data signals may be input in the order of the second data line, the third data line, and the first data line. That is, data signals are sequentially input to data lines coupled to a green sub-pixel G, a blue sub-pixel B, a red sub-pixel R, a green sub-pixel G, a white sub-pixel W. and a red sub-pixel R in one repetition unit, so that the corresponding sub-pixels are turned on to realize display. When data signals are input in the order of the second data line, the third data line and the first data line, the green sub-pixel G may be easily affected by a coupling effect caused by the jumped data signal in the blue sub-pixel B because the green sub-pixel G is turned on before the blue sub-pixel B.

The specific coupling process is as follows: in one repetition unit, when the polarity of the data signal input to the green sub-pixels G in the first column is negative (represented by "–" in the figure), the voltage of the data signal input to the adjacent blue sub-pixels B makes a downward jump, and this voltage jump pulls the data signal input to the green sub-pixels G downward, resulting in an increase in the absolute value of the voltage of the data signal input to the green sub-pixels G, and thus an increase in the brightness of the green sub-pixels G (represented by "↑" in the figure); and when the polarity of the data signal input to the green sub-pixels G in the second column is positive (represented by "+" in the figure), the voltage of the data signal input to the adjacent blue sub-pixels B makes a downward jump, and this voltage jump pulls the data signal input to the green sub-pixels G downward, resulting a decrease in the absolute value of the voltage of the data signal input to the green sub-pixels G, and thus a decrease in the brightness of the green sub-pixels G (represented by "↓" in the figure).

The display in the other sub-pixels follows the principle described above. It can be understood that the polarity of the input data signal is determined by the driving chip, the polarities of the data signals input to the sub-pixels in the same column are the same, and the polarities of the data signals in the data lines coupled to the same data selector are the same. Here, the polarities of the data signals in the display panel shown in FIG. 1 are merely taken as an example for explanation, and the polarities of the data signals in the same data line in adjacent two frames of displayed images are opposite. However, the polarities of the data signals input to the respective sub-pixels may be set in other manners, which are not listed here.

For the RB image, the signal jump state on the data line is shown in FIG. 2*b*, and the implementation principle is similar to that for the GB image described above with reference to FIG. 2*a*, and thus is not repeated here.

It can be seen from the above display process that the data signals are input in the same order in each frame of displayed image, so that the difference in brightness exists between different sub-pixels, and each frame of displayed image is lightened or darkened at the same position. Accordingly, the displayed image is prone to defects such as vertical stripes, which affects the display effect. In order to solve at least one of the above technical problems, the present disclosure provides a method for driving a display panel, a display panel and a display device. Next, the method for driving the display panel, the display panel and the display device according to embodiments of the present disclosure will be described in detail with reference to the accompanying drawings and specific implementations.

FIG. 3 is a schematic flowchart illustrating a method for driving a display panel according to an embodiment of the present disclosure.

The method for driving the display panel may be used to drive the display panel as shown in FIG. 1. As shown in FIG. 3, the method for driving the display panel includes steps S301 to S303.

At step S301, for one of adjacent two frames of displayed images, when scanning an odd-numbered row of sub-pixels, the data selector inputs data signals to the plurality of data lines coupled to the data selector in a first order, and when scanning an even-numbered row of sub-pixels, the data selector inputs data signals to the plurality of data lines coupled to the data selector in a second order; each of the first order and the second order represents an order of inputting data signals to the plurality of data lines coupled to the sub-pixels in different colors; and the first order is opposite to the second order.

At step S302, for the other of the adjacent two frames of displayed images, when scanning an odd-numbered row of sub-pixels, the data selector inputs data signals to the plurality of data lines coupled to the data selector in the second order, and when scanning an even-numbered row of sub-pixels, the data selector inputs data signals to the plurality of data lines coupled to the data selector in the first order.

In the method for driving the display panel according to the embodiment of the present disclosure, for one of adjacent two frames of displayed images, data signals are input to the sub-pixels in different colors in the odd-numbered row of sub-pixels in the first order, and data signals are input to the sub-pixels in different colors in the even-numbered row of sub-pixels in the second order, where the first order and the second order are opposite. When adjacent two rows of sub-pixels are scanned, the number of times of turning on the data selector can be reduced, and therefore the power consumption of the whole display panel can be reduced. Through practical tests, the power consumption can be reduced by 20 mW for a white image and 28 mW for a colorful image.

On the other hand, due to the jump in the voltage of the data signal received by parts of the sub-pixels in the display panel, the coupling effect may easily occur for the data signals in the adjacent data lines in the floating state. This will cause the absolute value of the voltage of the data signal input from the adjacent data line to increase or decrease, thereby causing the brightness of the sub-pixel coupled to the data line that is affected by the coupling effect to increase or decrease in the one frame of the displayed image. For the other frame of the adjacent two frames of displayed images, data signals are input to the sub-pixels in different colors in the odd-numbered row of sub-pixels in the second order, and data signals are input to the sub-pixels in different colors in the even-numbered row of sub-pixels in the second order, namely the data signals are input to the sub-pixels in different colors in a reverse order for the adjacent two frames of displayed images. The brightness at a sub-pixel position in an odd-numbered row in the one of the adjacent two frames of displayed images is increased, and the brightness at a sub-pixel position in an adjacent even-numbered row in the other frame of the adjacent two frames of displayed images is decreased. That is, the brightness changes at sub-pixel positions in the odd-numbered row and the even-numbered row in the adjacent two frames of displayed images are opposite. Accordingly, the brightness difference between the adjacent two frames of displayed images can be eliminated, so that the brightness of the sub-pixel position in the corresponding column is the same as the brightness of the surrounding sub-pixels. Therefore, the uniformity of the displayed image can be improved, the defects of vertical stripes of the displayed image can be avoided, and the display effect can be improved.

In some embodiments, a data line to which a data signal is last input in the first order is the same as a data line to which a data signal is first input in the second order; a data line to which a data signal is first input in the first order is the same as a data line to which a data signal is last input in the second order. For example, in the pixel array arranged as shown in FIG. 1, the data line to which the data signal is last input in the first order and the data line to which the data signal is first input in the second order may both be the first data line, and the data line to which the data signal is first input in the first order and the data line to which the data signal is last input in the second order may both be the second data line.

Exemplarily, taking the sub-pixels coupled to the data line to which the data signal is last input in the first order being the green sub-pixels G as an example, a green sub-pixel G is turned on last when the odd-numbered row of sub-pixels are scanned, and also a green sub-pixel G is turned on first when the adjacent even-numbered row of sub-pixels are scanned. Thus, the data selector can directly input data signals to the green sub-pixels G in different rows without performing one additional turning-on and turning-off operation. Therefore, the number of times of turning on the data selector can be reduced when adjacent two rows of sub-pixels are scanned, and the power consumption of the whole display panel can be further reduced.

In some embodiments, the display panel as shown in FIG. 1 may include a plurality of sub-pixels arranged in an array of a plurality of rows and a plurality of columns. Among the plurality of columns of sub-pixels, adjacent columns of sub-pixels have colors different from each other, and at least one column of sub-pixels includes alternately arranged sub-pixels having two different colors. The plurality of sub-pixels may also be arranged in an array in the form of a plurality of repetition units. Each repetition unit may include sub-pixels arranged in two rows and six columns, in which six sub-pixels in the first row are sequentially a red sub-pixel R, a green sub-pixel G, a blue sub-pixel B, a red sub-pixel R, a green sub-pixel G, and a white sub-pixel W; and six sub-pixels in the second row are sequentially a red sub-pixel R, a green sub-pixel G, a white sub-pixel W, a red sub-pixel R, a green sub-pixel G. and a blue sub-pixel B.

The display panel may further include a plurality of data selectors MUXs and a plurality of data lines. Each data line is coupled to sub-pixels arranged in the same column. For example, the data lines may include a first data line coupled to red sub-pixels R disposed in the first column, a second data line coupled to green sub-pixels G disposed in the second column, and a third data line coupled to blue sub-pixels B and white sub-pixels W disposed in the third column. Each data selector MUX is coupled to three data lines coupled to the red, green, and blue (or white) sub-pixels R, G, and B (or W), and each data selector MUX is coupled to the first, second, and third data lines as described above through first, second, and third data selection signal lines MUX1, MUX2, and MUX3, respectively.

In the method for driving the display panel, the first order may include: sequentially inputting data signals in the order of three data lines (i.e., the first data line, the third data line, and the second data line) respectively coupled to the red, blue, and green sub-pixels R, B, and G; and the second order may include: sequentially inputting data signals in the order of three data lines (i.e., the second data line, the third data line, and the first data line) respectively coupled to the green, blue, and red sub-pixels G, B, and R.

In some embodiments, for one frame of adjacent two frames of displayed images, when the odd-numbered row of sub-pixels are scanned, the order of the first data selection signal line MUX1, the third data selection signal line MUX3 and the second data selection signal line MUX2 is adopted (the timing diagram thereof is shown in FIG. 5*a*). It should be noted that in FIG. 5*a*, taking the odd-numbered row of sub-pixels being scanned first and then the even-numbered row of sub-pixels being scanned as an example, data signals are input to the data lines coupled thereto sequentially. That is, data signals are sequentially input to data lines coupled to a red sub-pixel R, a blue sub-pixel B, a green sub-pixel G, a red sub-pixel R, a white sub-pixel W, and a green sub-pixel G in one repetition unit. When the even-numbered row of sub-pixels are scanned, the data signals are sequentially input to the data lines coupled thereto in the order of the second data selection signal line MUX2, the third data selection signal line MUX3, and the first data selection signal line MUX1 (the timing diagram thereof is shown in FIG. 5*a*). That is, data signals are sequentially input to data lines coupled to a green sub-pixel G, a blue sub-pixel B, a red sub-pixel R, a green sub-pixel G, a white sub-pixel W. and a red sub-pixel R in one repetition unit. The signal jump state thereof on the data lines are the same as the signal jump state on the data lines shown in FIG. 2*a* and FIG. 2*b*, and the principle thereof is also the same, which is not described herein again. That is to say, FIG. 2*a* and FIG. 2*b* correspond to signal jump state on data lines when scanning sub-pixels for one of adjacent two frames of displayed images in the method for driving the display panel according to the present disclosure.

FIGS. 4*a* and 4*b* correspond to signal jump state on data lines when scanning sub-pixels for the other of adjacent two frames of displayed images in the method for driving the display panel according to the present disclosure. FIG. 4*a* is a schematic diagram illustrating another signal jump state on the data lines when a GB image is displayed on a display panel. As shown in FIG. 4*a*, taking a GB image as an example, for the other frame of adjacent two frames of displayed images, when the even-numbered row of sub-pixels are scanned, the order of the first data selection signal line MUX1, the third data selection signal line MUX3, and the second data selection signal line MUX2 is adopted (the timing diagram thereof is shown in FIG. 5*b*). Here, it should be noted that in FIG. 5*b*, taking the odd-numbered row of sub-pixels being scanned first and then the even-numbered row of sub-pixels being scanned as an example, data signals are input to the data lines coupled thereto sequentially. That is, data signals are sequentially input to data lines coupled to a red sub-pixel R, a blue sub-pixel B, a green sub-pixel G, a red sub-pixel R, a white sub-pixel W and a green sub-pixel G in one repetition unit, so that the corresponding sub-pixels are turned on to realize display.

During the display process, the blue sub-pixel B and the white sub-pixel W are located in the same column and coupled to the same data line. In the process of inputting the data signal, the data signal input each time is different, so that the voltage jumps. However, when the data signals are input in the above order, the green sub-pixel G is turned on after the blue sub-pixel B, and the voltage jump does not cause a coupling effect for the green sub-pixel G, so the brightness of the green sub-pixel G is not affected (represented by "–" in the figure).

When the even-numbered row of sub-pixels are scanned, the data signals are sequentially input to the data lines coupled thereto in the order of the second data selection signal line MUX2, the third data selection signal line MUX3, and the first data selection signal line MUX1 (the timing diagram thereof is shown in FIG. 5*b*). That is, data signals are sequentially input to data lines coupled to a green sub-pixel G, a blue sub-pixel B, a red sub-pixel R, a green sub-pixel G, a white sub-pixel W, and a red sub-pixel R in one repetition unit, so that the corresponding sub-pixels are turned on to realize display. When data signals are input in the above order, the green sub-pixel G may be easily affected by a coupling effect caused by the jumped data signal in the blue sub-pixel B because the green sub-pixel G is turned on before the blue sub-pixel B.

The specific coupling process is as follows: in one repetition unit, when the polarity of the data signal input to the green sub-pixels G in the first column is positive (represented by "+" in the figure), the voltage of the data signal input to the adjacent blue sub-pixels B makes a downward jump, and this voltage jump pulls the data signal input to the green sub-pixels G downward, resulting in a decrease in the absolute value of the voltage of the data signal input to the green sub-pixels G, and thus a decrease in the brightness of the green sub-pixels G (represented by "↓" in the figure); and when the polarity of the data signal input to the green sub-pixels G in the second column is negative (represented by "–" in the figure), the voltage of the data signal input to the adjacent blue sub-pixels B makes a downward jump, and this voltage jump pulls the data signal input to the green sub-pixels G downward, resulting an increase in the absolute value of the voltage of the data signal input to the green sub-pixels G, and thus an increase in the brightness of the green sub-pixels G (represented by "↑" in the figure).

The display in the other sub-pixels follows the principle described above. It can be understood that the polarity of the input data signal is determined by the driving chip, and the polarities of the data signals input to the sub-pixels in the same column are the same. Here, the polarities of the data signals in the display panel shown in FIG. 1 are merely taken as an example for explanation. However, the polarities of the data signals input to the respective sub-pixels may be set in other manners, which are not listed here. For the RB image, the signal jump state on the data lines is shown in FIG. 4*b*, and the implementation principle thereof is similar to that for the GB image, and thus is not repeated here.

It can be seen that the brightness increases at the position of the green sub-pixel G in the odd-numbered row in one of the adjacent two frames of displayed images, and the brightness decreases at the position of the green sub-pixel G in the adjacent even-numbered row in the other frame of the adjacent two frames of displayed images. That is, the brightness changes at the positions of the green sub-pixels G of the odd-numbered row and the even-numbered row in the adjacent two frames of displayed images are opposite. Thus, the brightness differences between the adjacent two frames of displayed images can be eliminated, so that the brightness of the position of the green sub-pixel G in the corresponding column is the same as the brightness of the surrounding sub-pixels. Therefore, the uniformity of the displayed image can be improved, the defects of vertical stripes of the displayed image can be avoided, and the display effect can be improved.

In some embodiments, a duration of inputting a data signal to a data line coupled to a blue sub-pixel B is longer than a duration of inputting a data signal to a data line coupled to a red sub-pixel R or a green sub-pixel G.

It should be noted that, the duration of inputting the data signal to the data line coupled to the blue sub-pixel B is longer than the duration of inputting the data signal to the data line coupled to the red sub-pixel R or the green sub-pixel G, so that it can be ensured that the blue sub-pixel B has a sufficient charging time. The specific duration can be set according to actual conditions. For example, the duration of inputting the data signal to the data line coupled to the blue sub-pixel B is T1, the duration of inputting the data signal to the data line coupled to the red sub-pixel R or the green sub-pixel G is T2, and the ratio of T1 to T2 may be 1.2 to 1.4, but other ratios are also possible, which are not listed herein.

In some embodiments, the display panel may further include: a plurality of gate lines G1 to G(n); each gate line is coupled to sub-pixels arranged in the same row; the method for driving the display panel may further include: step S303, inputting scan signals to the plurality of gate lines progressively according to a preset timing sequence. That is, the plurality of gate lines supply the scan signals to the plurality of sub-pixels row by row according to the preset timing sequence.

It should be noted that each gate line may be coupled to the sub-pixels arranged in the same row, and the scan signals may be input to the gate lines progressively according to a preset timing sequence, so as to control the sub-pixels in each row to be turned on row by row. The data selector inputs data signals row by row to the sub-pixels in each row through the data lines to realize a display function.

An embodiment of the present disclosure provides a display panel, which has the same structure as the display panel shown in FIG. 1, except that the display panel further includes a timing controller (not shown). The timing controller is coupled to the data selector; the timing controller is configured to: for one of adjacent two frames of displayed images, when scanning an odd-numbered row of sub-pixels, control the data selector to input data signals to the plurality of data lines coupled to the data selector in a first order, and when scanning an even-numbered row of sub-pixels, control the data selector to input data signals to the plurality of data lines coupled to the data selector in a second order, each of the first order and the second order representing an order of inputting data signals to the plurality of data lines coupled to the sub-pixels in different colors, the first order being opposite to the second order; for the other of the adjacent two frames of displayed images, when scanning an odd-numbered row of sub-pixels, control the data selector to input data signals to the plurality of data lines coupled to the data selector in the second order, and when scanning an even-numbered row of sub-pixels, control the data selector to input data signals to the plurality of data lines coupled to the data selector in the first order.

It should be noted that, for one of adjacent two frames of displayed images, the timing controller may perform a control such that data signals are input to the sub-pixels in different colors in the odd-numbered row of sub-pixels in the first order, and data signals are input to the sub-pixels in different colors in the even-numbered row of sub-pixels in the second order, where the first order and the second order are opposite. When adjacent two rows of sub-pixels are scanned, the number of times of turning on the data selector can be reduced, and therefore the power consumption of the whole display panel can be reduced. On the other hand, due to the jump in the voltage of the data signal input to a part of the sub-pixels in the display panel, the coupling effect occurs easily for the data signal in the adjacent data line in the floating state, which causes the absolute value of the voltage of the data signal input from the adjacent data line to increase or decrease, thereby causing the brightness of the sub-pixel coupled to the data line that is affected by the coupling effect to increase or decrease in the one frame of the displayed image. For the other frame of the adjacent two frames of displayed images, the timing controller may perform a control such that data signals are input to the sub-pixels in different colors in the odd-numbered row of sub-pixels in the second order, and data signals are input to the sub-pixels in different colors in the even-numbered row of sub-pixels in the second order, namely the data signals are input to the sub-pixels in different colors in a reverse order for the adjacent two frames of displayed images. The brightness at a sub-pixel position in an odd-numbered row in the one of the adjacent two frames of displayed images is increased, and the brightness at a sub-pixel position in an adjacent even-numbered row in the other frame of the adjacent two frames of displayed images is decreased, and the brightness changes at sub-pixel positions in the odd-numbered row and the even-numbered row in the adjacent two frames of displayed images are opposite, so that the brightness difference between the adjacent two frames of displayed images can be eliminated, and the brightness of the sub-pixel position in the corresponding column is the same as the brightness of the surrounding sub-pixels. Therefore, the uniformity of the displayed image can be improved, the defects of vertical stripes of the displayed image can be avoided, and the display effect can be improved.

In some embodiments, the first order includes: sequentially inputting data signals to three data lines coupled to a red sub-pixel R, a blue sub-pixel B (a white sub-pixel W), and a green sub-pixel G; and the second order includes: sequentially inputting data signals to three data lines coupled to a green sub-pixel G, a blue sub-pixel B (a white sub-pixel W), and red sub-pixels R.

It should be noted that, for one frame of adjacent two frames of displayed images, when scanning an odd-numbered row of sub-pixels, the timing controller may control the data selector to sequentially input the data signals to the data lines coupled to a red sub-pixel R, a blue sub-pixel B, a green sub-pixel G, a red sub-pixel R, a white sub-pixel W, a green sub-pixel G in one repetition unit. When scanning the even-numbered row of sub-pixels, the timing controller may control the data selector to sequentially input data signals to the data lines coupled to a green sub-pixel G, a blue sub-pixel B, a red sub-pixel R, a green sub-pixel G, a white sub-pixel W, and a red sub-pixel R in one repetition unit. The signal jump state on the data lines may be those as shown in FIGS. 2*a*, 2*b*, 4*a* and 4*b*, and the implementation principle thereof is the same as the above implementation principle, which is not described herein again.

In some embodiments, the display panel further includes: a first data selection signal line MUX1, a second data selection signal line MUX2, and a third data selection signal line MUX3; the first data selection signal line MUX1 is coupled to the data line coupled to the red sub-pixels R; the second data selection signal line MUX2 is coupled to the data line coupled to the green sub-pixels G; and the third data selection signal line MUX3 is coupled to the data line coupled to the blue sub-pixels B.

It should be noted that, the data selector may be controlled to be turned on by inputting the data selection signal to the first data selection signal line MUX1, the second data selection signal line MUX2, or the third data selection signal line MUX3, so that the data selector inputs the data signal to the corresponding data line, and the order of inputting the data signals to the data lines coupled to sub-pixels in different colors is adjusted. As a result, the brightness differences between the adjacent two frames of displayed images may be mutually offset, thereby avoiding the displayed images from generating the defect of vertical stripe, and further improving the display effect.

Figure 6:
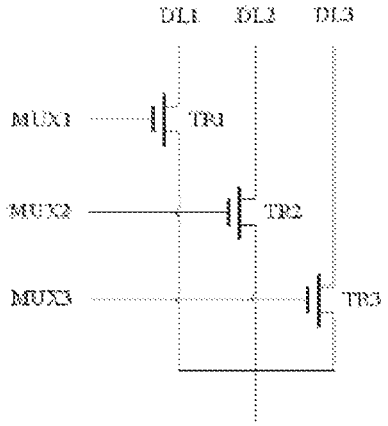
FIG. 6 is a block diagram illustrating an internal structure of an exemplary data selector.

FIG. 6 is a block diagram illustrating an internal structure of an exemplary data selector.

Referring to FIG. 6, the data selector MUX includes a first transistor TR1, a second transistor TR2, and a third transistor TR3. A control electrode of the first transistor TR1 is coupled to the first data selection signal line MUX1, and a first electrode thereof is coupled to the first data line DL1 coupled to the red sub-pixel R; a control electrode of the second transistor TR2 is coupled to the second data selection signal line MUX2, and a first electrode thereof is coupled to the second data line DL2 coupled to the green sub-pixel G; a control electrode of the third transistor TR3 is coupled to the third data selection signal line MUX3, and a first electrode thereof is coupled to the third data line DL3 coupled to the blue sub-pixel B; second electrodes of the first, second and third transistors TR1, TR2 and TR3 are coupled together to receive a data signal.

It should be noted that, taking the first transistor TR1 as an example, the first transistor TR1 may be turned on under the control of the data selection signal input to the first data selection signal line MUX1, and transmit the data signal input from the first electrode thereof to the corresponding red sub-pixel R. and similarly, the data signal may be transmitted to the corresponding green sub-pixel G through the second transistor TR2, and the data signal may be transmitted to the corresponding blue sub-pixel B through the third transistor TR3, so as to implement a color display.

An embodiment of the present disclosure provides a display device, where the display device includes the display panel provided in any of the above embodiments, and the display device may be a mobile phone, a tablet computer, a smart television, or another terminal device, and its implementation principle is the same as that of the display panel provided in the above embodiments, and will not be repeated here.

It will be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the present disclosure, and these changes and modifications are to be considered within the scope of the present disclosure.

What is claimed is:

1. A method for driving a display panel, wherein the display panel comprises a plurality of sub-pixels in an array of a plurality of rows and a plurality of columns, a plurality of data lines and a plurality of data selectors; wherein sub-pixels in adjacent columns of the plurality of columns have colors different from each other, and sub-pixels having two different colors are alternately arranged in at least one column of the plurality of columns; each of the plurality of data lines is coupled to sub-pixels in a same column, and each of the plurality of data selectors is coupled to the plurality of data lines coupled to sub-pixels in different colors;

wherein the method comprises:

for one of adjacent two frames of displayed images, when scanning an odd-numbered row of sub-pixels, inputting, by a data selector of the plurality of data selectors, data signals to the plurality of data lines coupled to the data selector in a first order, and when scanning an even-numbered row of sub-pixels, inputting, by the data selector, data signals to the plurality of data lines coupled to the data selector in a second order; each of the first order and the second order representing an order of inputting data signals to the plurality of data lines coupled to the sub-pixels in different colors; the first order being opposite to the second order; and for the other of the adjacent two frames of displayed images, when scanning an odd-numbered row of sub-pixels, inputting, by the data selector, data signals to the plurality of data lines coupled to the data selector in the second order, and when scanning an even-numbered row of sub-pixels, inputting, by the data selector, data signals to the plurality of data lines coupled to the data selector in the first order, wherein the plurality of sub-pixels comprises a plurality of repetition units in an array; each of the plurality of repetition units comprises sub-pixels in two rows and six columns, in which six sub-pixels in a first row are sequentially a red sub-pixel, a green sub-pixel, a blue sub-pixel, a red sub-pixel, a green sub-pixel, and a white sub-pixel; and six sub-pixels in a second row are sequentially a red sub-pixel, a green sub-pixel, a white sub-pixel, a red sub-pixel, a green sub-pixel, and a blue sub-pixel; the red sub-pixels are coupled to a first data line, the green sub-pixels are coupled to a second data line; and the blue sub-pixels and the white sub-pixels are coupled to a third data line;

the first order comprises an order of the first data line, the third data line and the second data line for each of the plurality of repetition units; and the second order comprises an order of the second data line, the third data line and the first data line for each of the plurality of repetition units.

2. The method of claim 1, wherein a data line to which a data signal is last input in the first order is the same as a data line to which a data signal is first input in the second order; and a data line to which a data signal is first input in the first order is the same as a data line to which a data signal is last input in the second order.

3. The method of claim 1, wherein a duration of inputting a data signal to the third data line is longer than a duration of inputting a data signal to the first or second data line.

4. The method of claim 1, wherein the display panel further comprises a plurality of gate lines; each of the plurality of gate lines is coupled to sub-pixels in a same row; and the method further comprises:

inputting scan signals to the plurality of gate lines row by row according to a preset timing sequence.

5. A display panel, comprising:

a plurality of sub-pixels in an array of a plurality of rows and a plurality of columns, wherein sub-pixels in adjacent columns of the plurality of columns have colors different from each other, and sub-pixels having two different colors are alternately arranged in at least one column of the plurality of columns;

a plurality of data lines, wherein each of the plurality of data lines is coupled to sub-pixels in a same column;

a plurality of data selectors, wherein each of the plurality of data selectors is coupled to the plurality of data lines coupled to sub-pixels in different colors; and a timing controller coupled to a data selector among the plurality of data selectors and configured to:

for one of adjacent two frames of displayed images, when scanning an odd-numbered row of sub-pixels, control the data selector to input data signals to the plurality of data lines coupled to the data selector in a first order, and when scanning an even-numbered row of sub-pixels, control the data selector to input data signals to the plurality of data lines coupled to the data selector in a second order; each of the first order and the second order representing an order of inputting data signals to the plurality of data lines coupled to the sub-pixels in different colors; the first order being opposite to the second order; and for the other of the adjacent two frames of displayed images, when scanning an odd-numbered row of sub-pixels, control the data selector to input data signals to the plurality of data lines coupled to the data selector in the second order, and when scanning an even-numbered row of sub-pixels, control the data selector to input data signals to the plurality of data lines coupled to the data selector in the first order, wherein the plurality of sub-pixels comprises a plurality of repetition units in an array; each of the plurality of repetition units comprises sub-pixels in two rows and six columns, in which six sub-pixels in a first row are sequentially a red sub-pixel, a green sub-pixel, a blue sub-pixel, a red sub-pixel, a green sub-pixel, and a white sub-pixel; and six sub-pixels in a second row are sequentially a red sub-pixel, a green sub-pixel, a white sub-pixel, a red sub-pixel, a green sub-pixel, and a blue sub-pixel; the red sub-pixels are coupled to a first data line, the green sub-pixels are coupled to a second data line; and the blue sub-pixels and the white sub-pixels are coupled to a third data line;

the first order comprises an order of the first data line, the third data line and the second data line for each of the plurality of repetition units; and the second order comprises an order of the second data line, the third data line and the first data line for each of the plurality of repetition units.

6. The display panel of claim 5, wherein the display panel further comprises a first data selection signal line, a second data selection signal line and a third data selection signal line;

the first data selection signal line is coupled to the first data line coupled to the red sub-pixels;

the second data selection signal line is coupled to the second data line coupled to the green sub-pixels; and the third data selection signal line is coupled to the third data line coupled to the blue sub-pixels.

7. The display panel of claim 6, wherein the data selector comprises a first transistor, a second transistor and a third transistor;

a control electrode of the first transistor is coupled to the first data selection signal line, and a first electrode of the first transistor is coupled to the first data line coupled to the red sub-pixels;

a control electrode of the second transistor is coupled to the second data selection signal line, and a first electrode of the second transistor is coupled to the second data line coupled to the green sub-pixels;

a control electrode of the third transistor is coupled to the third data selection signal line, and a first electrode of the third transistor is coupled to the third data line coupled to the blue sub-pixels; and second electrodes of the first, second and third transistors are coupled together to receive a data signal.

8. The display panel of claim 5, wherein the timing controller is further configured to control the data selector such that a duration of inputting a data signal to the third data line is longer than a duration of inputting a data signal to the first or second data line.

9. The display panel of claim 5, further comprising:

a plurality of gate lines, each of the plurality of gate lines being coupled to sub-pixels in a same row, wherein the plurality of gate lines are configured to supply scan signals to the plurality of sub-pixels row by row according to a preset timing sequence.

10. A display device, comprising the display panel of claim 5.

11. The display device of claim 10, wherein the display panel further comprises a first data selection signal line, a second data selection signal line and a third data selection signal line;

the first data selection signal line is coupled to the first data line coupled to the red sub-pixels;

the second data selection signal line is coupled to the second data line coupled to the green sub-pixels; and the third data selection signal line is coupled to the third data line coupled to the blue sub-pixels.

12. The display device of claim 11, wherein the data selector comprises a first transistor, a second transistor and a third transistor;

a control electrode of the first transistor is coupled to the first data selection signal line, and a first electrode of the first transistor is coupled to the first data line coupled to the red sub-pixels;

a control electrode of the second transistor is coupled to the second data selection signal line, and a first electrode of the second transistor is coupled to the second data line coupled to the green sub-pixels;

a control electrode of the third transistor is coupled to the third data selection signal line, and a first electrode of the third transistor is coupled to the third data line coupled to the blue sub-pixels; and second electrodes of the first, second and third transistors are coupled together to receive a data signal.

13. The display device of claim 10, wherein the timing controller is further configured to control the data selector such that a duration of inputting a data signal to the third data line is longer than a duration of inputting a data signal to the first or second data line.

14. The display device of claim 10, wherein the display panel further comprises:

a plurality of gate lines, each of the plurality of gate lines being coupled to sub-pixels in a same row, wherein the plurality of gate lines are configured to supply scan signals to the plurality of sub-pixels row by row according to a preset timing sequence.

* * * * *